US006238179B1

(12) United States Patent
Wunderwald et al.

(10) Patent No.: US 6,238,179 B1
(45) Date of Patent: May 29, 2001

(54) CENTRIFUGAL COMPRESSOR

(75) Inventors: Dirk Wunderwald, Baden; Joachim Bremer, Zürich; Ulf Christian Müller, Kirchdorf, all of (CH); Mihajlo Bothien, Waldshut-Tiengen (DE); Jürg Greber, Wettingen (CH)

(73) Assignee: Asea Brown Boveri AG, Baden (CH)

( * ) Notice: Subject to any disclaimer, the term of this patent is extended or adjusted under 35 U.S.C. 154(b) by 0 days.

(21) Appl. No.: 09/316,964

(22) Filed: May 24, 1999

(30) Foreign Application Priority Data

May 25, 1998 (EP) ..... 98810487

(51) Int. Cl.[7] ..... F01D 11/00

(52) U.S. Cl. ..... 415/110; 415/173.5; 415/116; 415/180; 415/175

(58) Field of Search ..... 415/110, 112, 415/116, 175, 180, 173.5, 174.5, 168.2, 169.1

(56) References Cited

U.S. PATENT DOCUMENTS 3,966,351 6/1976 Sproule ..... 415/175
4,459,802 * 7/1984 Mowill ..... 415/169.1
5,297,928 * 3/1994 Imakiire et al. ..... 415/112

FOREIGN PATENT DOCUMENTS 249336 7/1912 (DE) .
357860 9/1922 (DE) .
4125763A1 2/1993 (DE) .
0518027A1 12/1992 (EP) .
0518027B1 12/1992 (EP) .
73442 10/1953 (NL) .

* cited by examiner

*Primary Examiner*—Edward K. Look
*Assistant Examiner*—Richard Woo
(74) *Attorney, Agent, or Firm*—Burns, Doane, Swecker & Mathis, L.L.P.

(57) ABSTRACT

The object of the invention is to create a centrifugal compressor with a cooling appliance which is simpler but more effective. This is achieved by the feed device (27) for the gaseous cooling medium (31) opening into the separating gap upstream of the mainly radially extending gap region (20) of the separating gap (18).

6 Claims, 3 Drawing Sheets

1
2
3
4
5
6
7
8
9
10
11
12
13
14
15
16
17
18
19
20
21
22
23
24
25
26
27
28
29
31
32

CENTRIFUGAL COMPRESSOR

BACKGROUND OF THE INVENTION

1. Field of the Invention

The invention relates to a centrifugal compressor.

2. Discussion of Background

Contactless seals, in particular labyrinth seals, are widely used for sealing rotating systems in turbomachine construction. A high frictional loss occurs in the separating gap through which fluid flows between the rotating and stationary parts because of the boundary layers formed in the flow. This causes heating of the fluid in the separating gap and therefore produces heating of the components surrounding the separating gap. The high material temperatures cause a reduction in the life of the corresponding components.

A centrifugal compressor with a labyrinth seal arranged on the rear wall of the compressor impeller in the separating gap between the compressor casing and the compressor impeller is known from EP 0 518 027 B1. Because of the high pressure at the outlet of the compressor impeller, leakage air can penetrate into the annular space between the rotating wall and the stationary wall of the compressor casing. In order to avoid both this and also the associated heating of the components surrounding the separating gap, a cold gas at a higher pressure than that at the outlet of the compressor impeller is introduced into the separating gap. For this purpose, an additional annular space is arranged within the labyrinth seal and is connected to an external gas feed. The cold gas flows through the wall of the compressor casing into the labyrinth seal and then impinges on and cools the rear wall of the compressor impeller. When it impinges on the rear wall, the gas is divided and mainly flows radially inward and outward through the individual sealing elements of the labyrinth seal. The partial flow directed radially outward, in particular, is intended to prevent hot compressor air from the outlet of the compressor impeller from flowing through the separating gap.

Despite special ancillary components, which make the centrifugal compressor more expensive, the cooling effect of such a solution cannot be considered optimum. The fact is, rather, that during the feed of the cold gas, mixing initially occurs between the partial flow directed radially outward and the boundary layer forming on the rear wall of the compressor impeller. In addition, this partial flow has to do work against at least one sealing element of the contactless seal which, in addition to the worse cooling effect, also causes greater friction on the rear wall and therefore greater mechanical losses.

SUMMARY OF THE INVENTION

The invention attempts to avoid all these disadvantages. Accordingly, one object of the invention is to provide a novel centrifugal compressor with a cooling appliance which is simpler but more effective.

In accordance with the invention, this object is achieved for an appliance by the feed device for the gaseous medium opening into the separating gap upstream of the mainly radially extending gap region of the separating gap.

With this solution, it is possible to dispense with an additional annular space or additional feed spaces in the mainly radially extending gap region of the separating gap. This markedly simplifies the construction of the centrifugal compressor. In addition, the cooling medium employed can replace the hot leakage air which otherwise penetrates into the mainly radially extending gap region of the separating gap. Because of this, the boundary layer formed by the flow on the rear wall of the compressor impeller is formed from the outset mainly by the cooling medium supplied. In particular, an improved cooling effect can therefore be ensured in this particularly endangered region of the centrifugal compressor.

It is particularly useful for the supply duct of the feed device and the inlet region of the mainly radially extending gap region of the separating gap to be arranged so that they are radially aligned. In this way, both pressure losses in the entering cooling medium and its heating due to dissipation can be avoided. This in turn leads to an improved cooling effect. In addition, the cooling medium stops the hot leakage air penetrating into the mainly radially extending gap region either partially, or even completely.

It is, furthermore, advantageous for a plurality of feed ducts for the cooling medium directed in the direction of rotation of the compressor impeller to be arranged in the supply duct. For this purpose, the supply duct has a plurality of guide webs interrupted by recesses, the recesses simultaneously forming the feed ducts for the cooling medium. While using relatively simple components, this makes it possible to inject the cooling medium in the direction of rotation of the compressor impeller, which further reduces the frictional losses and, therefore, the heating of the compressor impeller.

Finally, a sealing element is advantageously arranged in the separating gap upstream of the inlet region of the mainly radially extending gap region. This makes it possible to reduce the pressure of the leakage flow arriving from the compressor impeller to such an extent that the cooling medium can also be fed in at a pressure which is less than that present at the compressor outlet.

A combination of the measures already mentioned above with a contactless seal downstream of the inlet region in the mainly radially extending gap region of the separating gap has been found to be particularly advantageous. By this means, the cooling medium arriving from a radially outward position reaches the individual sealing elements of the seal and there causes film cooling of the rear wall of the compressor impeller. In contrast to the prior art, the cooling medium does not flow radially outward but radially inward so that mixing with the boundary layer formed by the flow on the rear wall of the compressor impeller does not occur nor, likewise, does any increase in the friction on the rear wall. In consequence, the cooling effectiveness can be increased and the life of the compressor impeller can be further improved.

BRIEF DESCRIPTION OF THE DRAWINGS

A more complete appreciation of the invention and many of the attendant advantages thereof will be readily obtained as the same becomes better understood by reference to the following detailed description, using the centrifugal compressor of an exhaust gas turbocharger, when considered in connection with the accompanying drawings, wherein.

Only these elements essential to understanding of the invention are shown. Not shown, for example, are the bearing part and the turbine end of the exhaust gas turbocharger. The flow direction of the working media is indicated by arrows.

DESCRIPTION OF THE PREFERRED EMBODIMENTS

Figure 1:
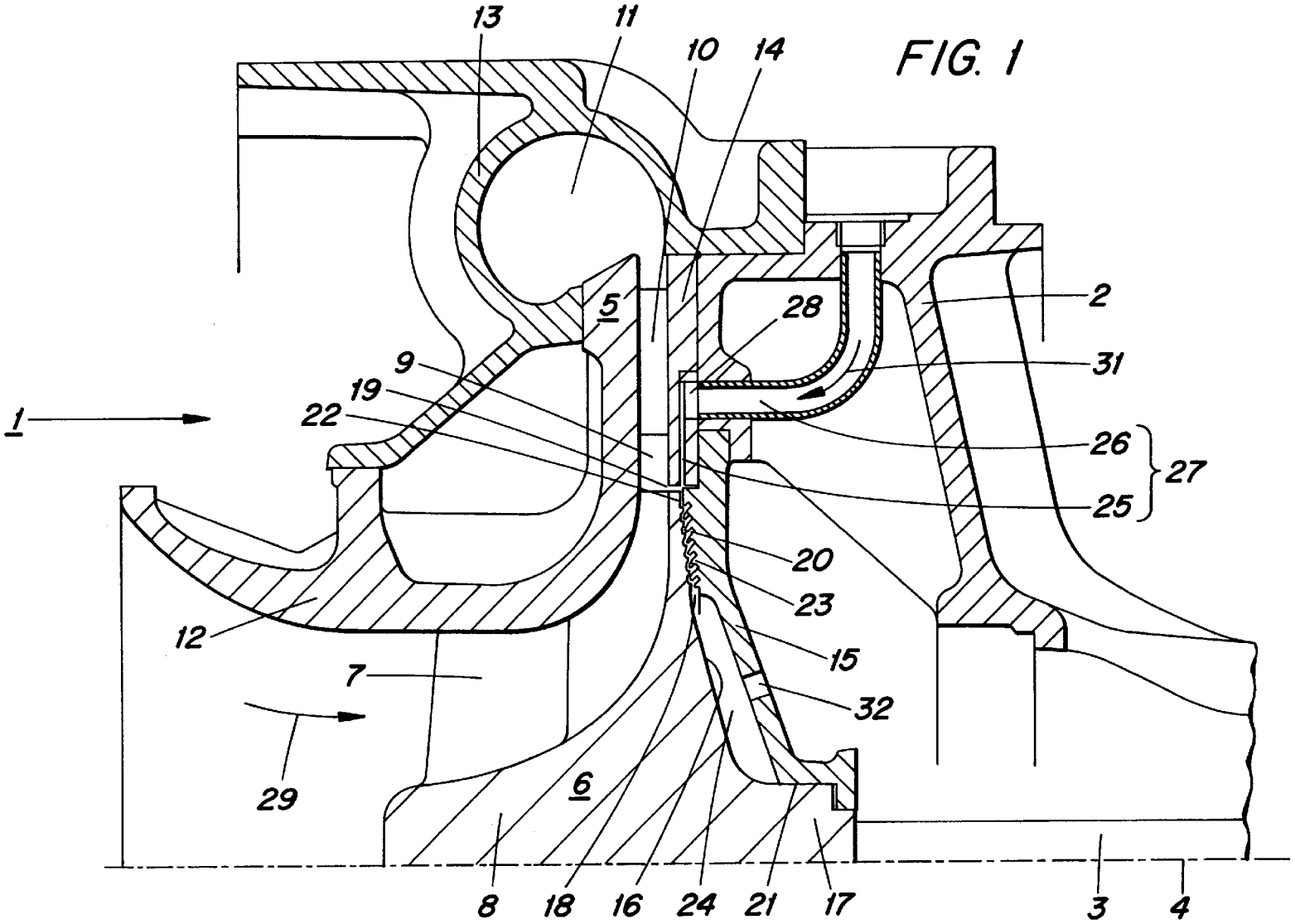
FIG. 1 shows a partial longitudinal section through the centrifugal compressor with the feed device according to the invention.

Referring now to the drawings, wherein like reference numerals designate identical or corresponding parts throughout the several views, in FIG. 1 the exhaust gas turbocharger (only partially shown) comprises a centrifugal compressor 1 and an exhaust gas turbine (not shown) which are connected together by means of a shaft 3 supported in a bearing housing 2. The centrifugal compressor 1 has a machine axis 4, which is located within the shaft 3. It is equipped with a compressor casing 5 in which a compressor impeller 6 is rotatably connected to the shaft 3. The compressor impeller 6 has a hub 8 fitted with a plurality of impeller vanes 7. A flow duct 9 is formed between the hub 8 and the compressor casing 5. Downstream of the impeller vanes 7, the flow duct 9 is followed by a radially arranged, vaned diffuser 10 which opens, in turn, into a volute 11 of the centrifugal compressor 1. The compressor casing 5 mainly comprises an air inlet casing 12, an air outlet casing 13, a diffuser plate 14 and an intermediate wall 15 to the bearing housing 2.

At the turbine end, the hub 8 has a rear wall 16 and a fastening sleeve 17 for the shaft 3, the latter and the fastening sleeve 17 being fastened together. The fastening sleeve 17 is accommodated by the intermediate wall 15 of the compressor casing 5. Another suitable compressor impeller/shaft combination can also, of course, be selected. The employment of an unvaned diffuser is likewise also possible.

A separating gap 18 comprising various gap regions is formed between the rotating compressor impeller 6 and the stationary intermediate wall 15 of the compressor casing 5. A first gap region 19 extends parallel to the machine axis 4 and is connected both to the outlet of the compressor impeller 6 and to a mainly radially extending, second gap region 20 in the region of the rear wall 16 of the compressor impeller 6. The second gap region 20 merges into a third gap region 21 formed between the fastening sleeve 17 and the intermediate wall 15 and likewise extending parallel to the machine axis 4. An inlet region 22 following on from the first gap region 19, a contactless seal 23 in the form of a labyrinth seal and an intermediate space 24 connected to the third gap region 21 are constituents of the mainly radially extending, second gap region 20. The intermediate space 24 communicates in turn with an outlet conduit (not shown).

A feed device 27 comprises a supply duct 25 and a feed conduit 26 opens into the separating gap 18 upstream of the second gap region 20. For this purpose, the central region of the diffuser plate 14 is provided with an opening 28 to accommodate the feed conduit 26 and has a slot configured as a supply duct 25 at its radially inner end. The supply duct 25 is arranged to be radially aligned with the inlet region 22 of the second gap region 20 of the separating gap 18.

When the exhaust gas turbocharger is in operation, the compressor impeller 16 induces, as the working medium 29, ambient air which reaches the volute 11 via the flow duct 9 and the diffuser 10, is compressed there and is finally employed for supercharging an internal combustion engine (not shown) connected to the exhaust gas turbocharger. On its way from the flow duct 9 to the diffuser 10, the ambient air 29 heated in the centrifugal compressor 1 is also admitted as a leakage flow 30 to the first gap region 19 and therefore to the separating gap 18. At the same time, however, a gaseous cooling medium 31 is introduced via the feed device 27 into the second gap region 20 of the separating gap 18. This can, for example, be air from the outlet (not shown) of the intercooler of the internal combustion engine. The use of other cooling media and of an external feed for the cooling medium are both, of course, possible.

The cooling medium 31 replaces the hot leakage flow 30 so that the boundary layer formed on the rear wall 16 of the compressor impeller 6 is already mainly formed from the outset by the fed cooling medium 31. Because, furthermore, the cooling medium 31 flows only radially inward, it is possible to achieve a markedly improved cooling effect, on the one hand, and also to reduce the frictional losses, on the other. The cooling medium 31, together with the leakage flow 30 of the working medium 29, is finally passed via the intermediate space 24 and via a removal device 32 engaging in the intermediate wall 15 of the compressor casing 5 (not further shown) out of the separating gap 18.

Figure 3:
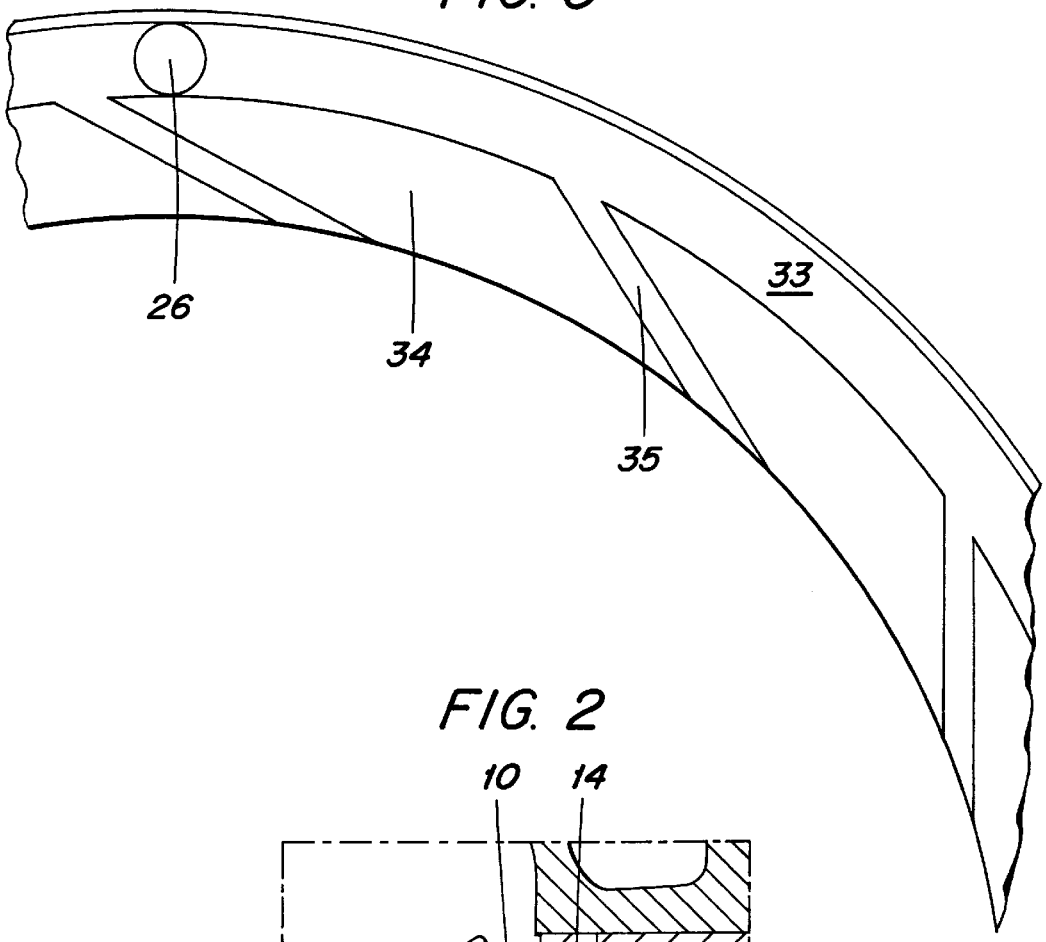
FIG. 3 shows a partial section through the feed duct of the feed device, along the line III—III in FIG. 2.
Figure 2:
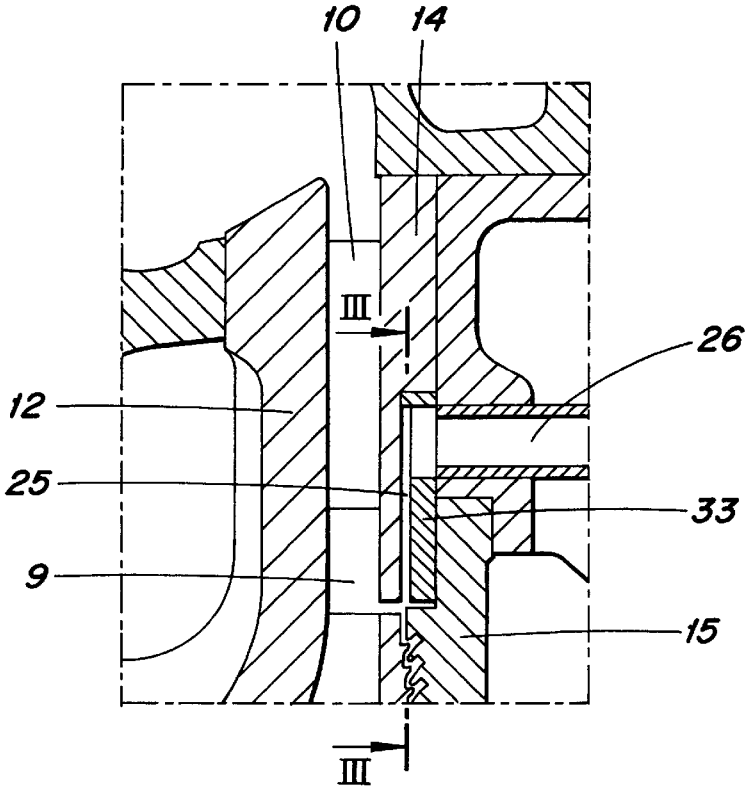
FIG. 2 shows a detail from FIG. 1 in the region of the diffuser plate in accordance with a second embodiment example.

In a second embodiment example, the diffuser plate 14 is provided with an intermediate ring 33 accommodating the feed conduit 26 in the region of the supply duct 25 (FIG. 2). The intermediate ring 33 has a plurality of guide webs 34 distributed over its periphery and these are interrupted by recesses in the form of feed ducts 35 (FIG. 3). The guide webs 34 are then configured in such a way that the feed ducts 35 point in the direction of rotation of the compressor impeller 6. This provides so-called positively swirled injection of the cooling medium 31, which markedly reduces the frictional loss and therefore the heating of the compressor impeller 6. This function can also, of course, be achieved by appropriately profiling the diffuser plate 14 in the region of the supply duct 25 (not shown).

Figure 4:
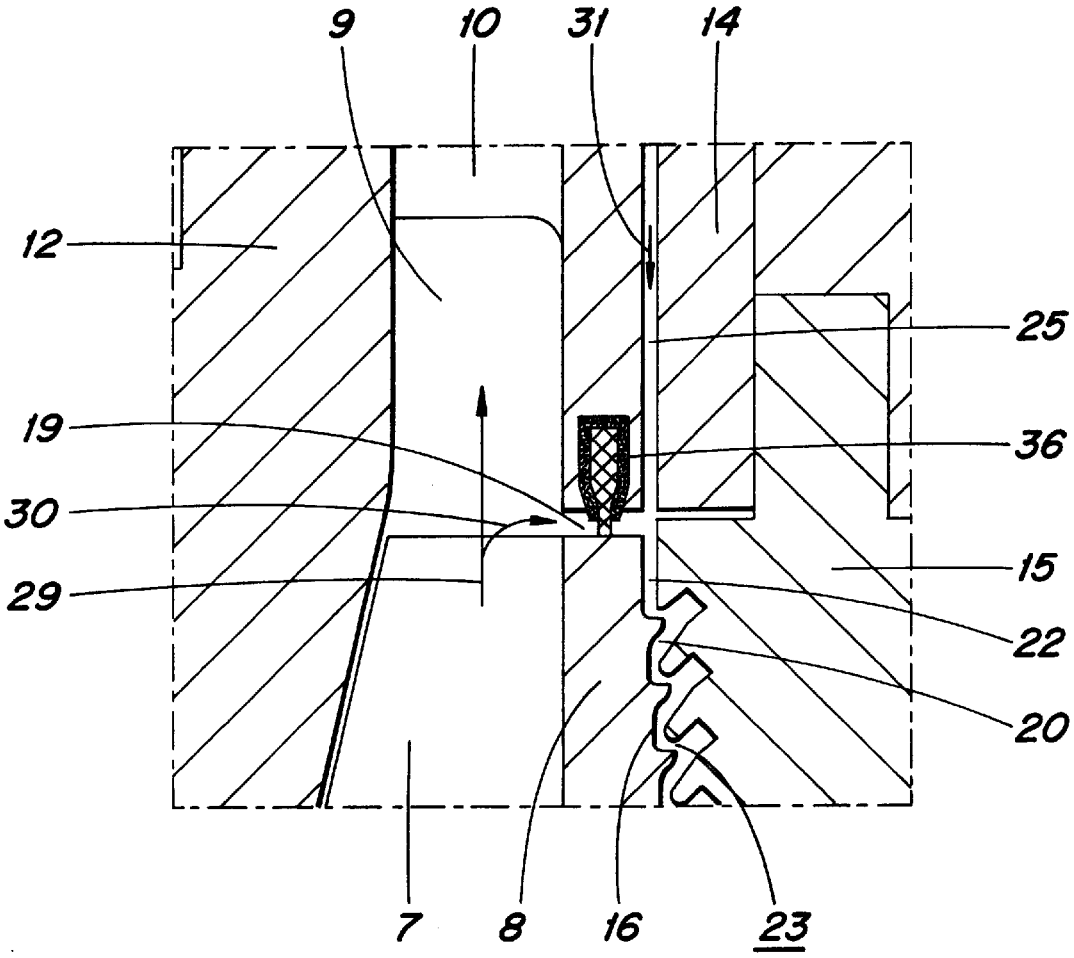
FIG. 4 shows an enlarged detail from FIG. 1 in the inlet region of the mainly radially extending gap region of the separating gap, but in a third embodiment example.

In a third embodiment example, a sealing element 36 is arranged in the separating gap 18 upstream of the inlet region 22 of the second gap region 20 (FIG. 4). With the aid of this sealing element 36, it is possible to reduce the pressure of the residual leakage flow 30 to such an extent that the pressure of the entering cooling medium 31 can advantageously even be less than the pressure of the working medium 29 present at outlet of the compressor impeller 6. In this way, effective cooling of the compressor impeller 6 can be ensured even with relatively small quantities of cooling medium 31.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A centrifugal compressor having a compressor impeller with a rear wall which is arranged on a shaft and extends mainly radially, having a compressor casing enclosing the compressor impeller, having a flow duct for a working medium of the centrifugal compressor, which flow duct is formed between the compressor impeller and the compressor casing and having a separating gap from the compressor impeller and the compressor casing, which separating gap is connected to the flow duct, and having a feed device for a gaseous cooling medium, arranged in the compressor casing, and a corresponding removal device, the feed device opening into the separating gap and the separating gap having a mainly radially extending gap region in the region of the rear wall of the compressor impeller, wherein the feed device opens into the separating gap upstream of the mainly radially extending gap region of the separating gap.

2. The centrifugal compressor as claimed in claim 1, wherein the feed device has a supply duct and the mainly radially extending gap region of the separating gap has an inlet region, the supply duct and the inlet region being arranged so that they are radially aligned.

3. The centrifugal compressor as claimed in claim 2, wherein a plurality of feed ducts pointing in the direction of rotation of the compressor impeller are arranged in the supply duct.

4. The centrifugal compressor as claimed in claim 3, wherein a plurality of guide webs interrupted by recesses are arranged in the supply duct and the recesses form the feed ducts.

5. The centrifugal compressor as claimed in claim 4, wherein a sealing element is arranged in the separating gap upstream of the inlet region of the mainly radially extending gap region.

6. The centrifugal compressor as claimed in claim 2, wherein a contactless seal is arranged downstream of the inlet region in the mainly radially extending gap region of the separating gap.

* * * * *